US007341048B2

(12) United States Patent
Koyama et al.

(10) Patent No.: US 7,341,048 B2
(45) Date of Patent: Mar. 11, 2008

(54) FUEL VAPOR TREATMENT APPARATUS

(75) Inventors: Nobuhiko Koyama, Nagoya (JP); Kenji Nagasaki, Nagoya (JP); Shinsuke Kiyomiya, Seto (JP)

(73) Assignees: Denso Corporation, Kariya, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 92 days.

(21) Appl. No.: 11/453,049

(22) Filed: Jun. 15, 2006

(65) Prior Publication Data

US 2006/0283427 A1 Dec. 21, 2006

(30) Foreign Application Priority Data

Jun. 15, 2005 (JP) ..... 2005-174815

(51) Int. Cl.
*F02M 51/00* (2006.01)
*F02M 33/02* (2006.01)

(52) U.S. Cl. ..... 123/518; 123/519; 123/520; 73/119 A

(58) Field of Classification Search ..... 123/516, 123/518, 519, 520; 73/119 A
See application file for complete search history.

(56) References Cited

U.S. PATENT DOCUMENTS

| | | | | |
|---|---|---|---|---|
| 5,186,153 | A * | 2/1993 | Steinbrenner et al. | 123/519 |
| 5,216,995 | A | 6/1993 | Hosoda et al. | |
| 6,971,375 | B2 | 12/2005 | Amano et al. | |
| 7,234,450 | B1 * | 6/2007 | Takakura et al. | 123/494 |
| 2006/0042605 | A1 | 3/2006 | Amano et al. | |
| 2007/0175455 | A1 * | 8/2007 | Amano et al. | 123/520 |
| 2007/0246024 | A1 * | 10/2007 | Sato | 123/520 |

FOREIGN PATENT DOCUMENTS

JP 5-18326 1/1993

* cited by examiner

*Primary Examiner*—Thomas Moulis
(74) *Attorney, Agent, or Firm*—Nixon & Vanderhye P.C.

(57) ABSTRACT

A concentration-detecting unit detects concentration of fuel vapor flowing in a concentration-detecting passage branched from a purge passage. The concentration-detecting passage communicates with a communicating passage of a canister. Air including the fuel vapor of which concentration is detected by a concentration-detecting unit is returned to the communicating passage of the canister. The fuel vapor is adsorbed by an absorbent accommodated in a accommodating chamber to restrict a discharge of the fuel vapor into atmosphere.

8 Claims, 5 Drawing Sheets

FUEL VAPOR TREATMENT APPARATUS

CROSS-REFERENCE TO RELATED APPLICATION

This application is based on Japanese Patent Applications No. 2005-174815 filed on Jun. 15, 2005, the disclosure of which is incorporated herein by reference.

FIELD OF THE INVENTION

The present invention relates to a fuel vapor treatment apparatus that treats fuel vapor produced in a fuel tank of an internal combustion engine.

BACKGROUND OF THE INVENTION

A fuel vapor treatment apparatus includes a canister which temporarily adsorbs fuel vapor evaporated in a fuel tank. The fuel vapor described from the canister is introduced and purged, through a purge passage, into an intake passage of the internal combustion engine by intake pressure. Amount of air including the fuel vapor, which is purged into the intake passage, is controlled by a purge control valve disposed in the purge passage.

The purged fuel vapor is combated in the engine with the fuel supplied from a fuel injector. Hence, it is necessary to accurately measure the amount of fuel vapor in order to keep an air-fuel ratio within a predetermined range.

JP-5-18326A and JP-5-33733A (U.S. Pat. No. 5,216,995) show a system in which concentration of the fuel vapor is detected by use of a flowmeter. Since the flowmeter is disposed in the purge passage, the concentration of the fuel vapor can be detected only when the air including the fuel vapor described from the canister flows in the purge passage. In order to detect the concentration anytime, a concentration detecting passage can be branched from the purge passage to provide a concentration-detecting unit therein. However, in a case that the concentration detecting passage is connected to an atmosphere port of the canister, the fuel vapor that has returned to the canister through the concentration-detecting unit is adsorbed by the absorbent at a vicinity of the atmosphere port. At this moment, when the engine is stopped to terminate the purging of the fuel vapor, the fuel vapor returned to the atmosphere port is diffused into the atmosphere passage. One end of the atmosphere passage is connected to the canister, and the other end is opened to the atmosphere. Thus, the fuel vapor which has returned to the atmosphere port could have been discharged into the atmosphere through the atmosphere passage.

SUMMARY OF THE INVENTION

The present invention is made in view of the above matters, and it is an object of the present invention to provide a fuel vapor treatment apparatus which can detect the concentration of the fuel vapor accurately and can restrict the discharge of the fuel vapor into the atmosphere.

According to a fuel vapor treatment apparatus of the present invention, a concentration-detecting passage connecting the purge passage with the canister introduces the fuel vapor into a space between the atmosphere port and the purge port. The fuel vapor, which has returned to the canister through the concentration-detecting passage, flows through the adsorbent accommodated in the canister until it reaches the atmosphere port. The fuel vapor is adsorbed by the adsorbent before it is discharged into the atmosphere passage through the atmosphere port. The discharge of the fuel vapor into the atmosphere is restricted. The concentration-detecting passage connects the purge passage with the canister. That is, the concentration-detecting passage is branched from the purge passage and is connected to the canister through the concentration-detecting unit. The fuel vapor flowing in the purge passage is introduced into the concentration-detecting unit without respect to an air flow in the purge passage. Thus, the concentration of the fuel vapor is accurately detected.

BRIEF DESCRIPTION OF THE DRAWINGS

Other objects, feature and advantages of the present invention will become more apparent from the following detailed description made with reference to the accompanying drawings, in which like parts are designated by like reference numerals and in which.

DETAILED DESCRIPTION OF THE PREFERRED EMBODIMENTS

First Embodiment

Figure 1:
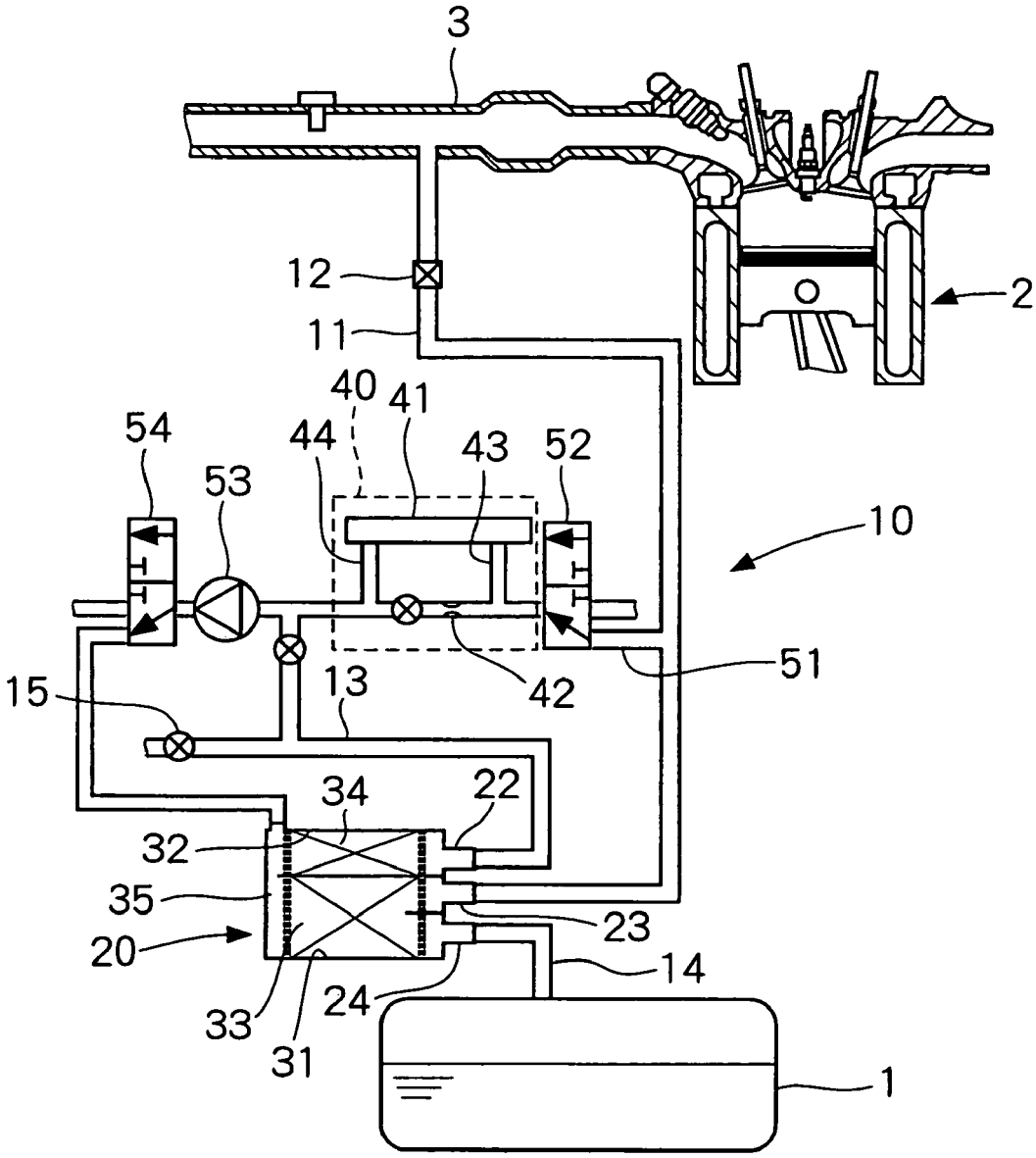
FIG. 1 is a schematic view of a fuel vapor treatment apparatus according to a first embodiment.

Referring to FIG. 1, a fuel vapor treatment apparatus 10 introduces a fuel vapor evaporated in a fuel tank 1 into an intake pipe 3 of an engine 2. The apparatus 10 includes a canister 20, a purge valve 12 provided in a purge passage 11, and a concentration-detecting unit 40. The apparatus can be provided with a fuel vapor leak detecting apparatus.

Figure 2:
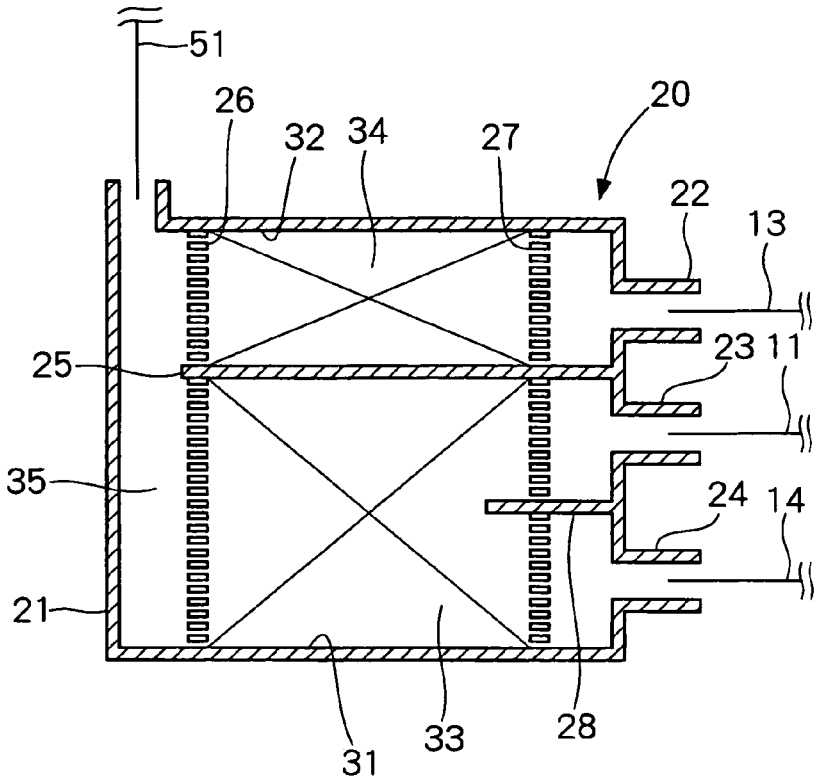
FIG. 2 is a cross sectional view showing a canister schematically according to the first embodiment.

As shown in FIG. 2, the canister 20 has a casing 21, which is made from metallic material or a resin material. The casing 21 is provided with an atmosphere port 22, a purge port 23, and a tank port 24. The atmosphere port 22 communicates with an atmosphere passage 13. The purge port 23 communicates with the intake pipe 3 through the purge passage 11. The tank port 24 communicates with the fuel tank 1 through a tank passage 14.

The canister 20 is provided with a first separator 25, a first holding plate 26, and a second holding plate 27, whereby a first accommodating chamber 31 and a second accommodating chamber 32 are defined therein. The first separator 25 is formed integrally with the casing 21. The first and second accommodating chambers 31, 32 accommodate a first and second adsorbents 33, 34 respectively. The adsorbents 33, 34 are made from porous material, such as activated charcoal or silica gel. The purge port 23 and the tank port 24 communicate with the first accommodating chamber 31. The atmosphere port 22 communicates with the second accommodating chamber 32. The first and second holding plates 26, 27 have multiple openings which extend in a thickness direction thereof, whereby air flow between the first accommodating chamber 31 and the second accommodating chamber 32 is allowed. The first and second holding plates 26, 27 hold the adsorbents 33, 34 in the chambers 31, 32.

The first accommodating chamber 31 and the second accommodating chamber 32 communicate with each other through a communicating passage 35 that is defined by the casing 21 and the first holding plate 26 therebetween. A second separator 28 separates the purge port 23 from the tank port 24 in the first accommodating chamber 31, whereby the fuel vapor introduced into the canister 20 through the tank port 24 is adsorbed by the first adsorbent 33 without making a short-circuit from the tank port 24 to the purge port 23.

The canister 20 communicates with the intake pipe 3 through the purge port 23 and the purge passage 11 as shown in FIG. 1. The purge passage 11 is provided with the purge valve 12 which adjusts the amount of air including the fuel vapor, which flows into the intake pipe 3 from the canister 20.

The atmosphere port 22 communicates with the atmosphere passage 13. The atmosphere passage 13 is provided with a drain valve 15 for opening and closing the atmosphere passage 13. One end of the atmosphere passage 13, which is opposite to the canister 20, is opened to the atmosphere through an air filter (not shown). When the fuel vapor leak check is conducted, the drain valve 15 closes the atmosphere passage 13.

A concentration-detecting passage 51 is branched from the purge passage 11. The concentration-detecting passage 51 is provided with first switching valve 52, a concentration-detecting unit 40, a pump 53, and a second switching valve 54. A first end of the concentration-detecting passage 51 communicates with the purge passage 11, and a second end of the concentration-detecting passage 51 communicates with the communicating passage 35. When the pump 53 is driven, a part of air flowing in the purge passage 11 flows into the communicating passage 35 through the concentration-detecting passage 51. The first switching valve 52 connects/disconnects the purge passage 11 with the concentration-detecting passage 51. The second switching valve 54 connects/disconnects an outlet of the pump 53 with the canister 20. An ECU (not shown) controls the first switching valve 52, the second switching valve 54, the concentration-detecting unit 40, and the pump 53. The ECU detects a rotational speed of the pump 53 based on voltage or current supplied to the pump 53. The ECU computes the concentration of the fuel vapor that is contained in the air flowing in the concentration-detecting passage 51 on the basis of a differential pressure detected by the concentration-detecting unit 40.

The concentration-detecting unit 40 includes a pressure sensor 41 and an orifice 42. A first passage 43 and a second passage 44 are branched from the concentration-detecting passage 51. A differential pressure sensor 41 is connected to the first passage 43 and the second passage 44. The concentration-detecting passage 51 is provided with an orifice 42 between the first passage 43 and the second passage 44. The orifice 42 causes a differential pressure between the first passage 43 and the second passage 44. A specific gravity of the fuel vapor is grater than that of the air. Hence, according as the concentration of the fuel vapor increases, the differential pressure between the first passage 43 and the second passage 44 increases.

The pressure sensor 41 detects the pressure in the concentration-detecting passage 51 on the basis of the differential pressure between the first passage 43 and the second passage 44. The ECU computes the concentration of the fuel vapor based on predetermined map-data. The concentration of the fuel vapor which is included in the air flowing in the purge passage 11 from the canister toward the intake pipe 3.

The air including the fuel vapor, which has flown into the concentration-detecting passage 51 from the purge passage 11, returns to the canister 20 through the concentration-detecting unit 40. In this embodiment, the concentration-detecting passage 51 communicates with the communicating passage 35 of the canister 20. Hence, the air including the fuel vapor passed through the concentration-detecting unit 40 returns to the communicating passage of the canister 20 in a situation that the pump 53 is driven. The fuel vapor is adsorbed by the adsorbent 33 in the first accommodating chamber 31. In a situation that the pump 53 is stopped, the fuel vapor flows into the adsorbent 34 in the second accommodating chamber 32, and then flows out from the canister 20.

The operation of the fuel vapor treatment apparatus 10 is described hereinafter.

According as the fuel vapor is produced in the fuel tank 1, the interior pressure of the fuel tank 1 increases, so that the air including the fuel vapor flows into the canister 20. While the engine 2 is stopped, the drain valve 15 is opened and the atmosphere passage 13 is opened to the atmosphere. The fuel vapor is introduced to the first accommodating chamber 31 through the tank passage 14 and the tank port 24. Most of the fuel vapor is adsorbed by the adsorbent 33 in the first accommodating chamber 31. The air passed through the first accommodating chamber 31 flows into the second accommodating chamber 32 through the communicating passage 35, whereby the fuel vapor contained in the air is adsorbed by the adsorbent 34 in the second accommodating chamber 32.

While the engine 2 is driven, the intake pressure is generated in the intake pipe 3 to reduce the interior pressure of the canister 20. At this moment, since the drain valve 15 is opened, the air is introduced into the canister 20 through the atmosphere passage 13. The air flows toward the purge passage 11 through the atmosphere port 22, the second accommodating chamber 32, the communicating passage 35, and the first accommodating chamber 31. Thereby, the fuel vapor adsorbed by the adsorbents 34, 35 is described. The described fuel vapor is flows into the purge passage 11 with the air introduced through the atmosphere passage 13.

The ECU controls the purge valve 12 to adjust the amount of air including the fuel vapor, which flows into the intake pipe 3 from the purge passage 11, on the basis of the concentration of the fuel vapor detected by the concentration-detecting unit 40. Thereby, the air-fuel ratio of the air is kept in an appropriate range. The air including the fuel vapor evaporated in the fuel tank 1 is introduced into the first accommodating chamber 31 through the tank passage 14 and the tank port 24. The fuel vapor flows into the purge passage 11 through the first accommodating chamber 31.

The air including the fuel vapor is introduced into the concentration-detecting passage 51 to detect the concentration of the fuel vapor. This air returns to the communicating passage 35 of the canister 20 through the concentration-detecting unit 40. Hence, even if the engine 2 is turned off at a time when the concentration is detected, the air including the fuel vapor in the concentration-detecting passage 51 flows into the communicating passage 35 of the canister 20. The fuel vapor which has returned to the canister from the concentration-detecting passage 51 recirculate through the adsorbent 33 in the first accommodating chamber 31 to the purge passage 11, while the pump 53 is driven. When the pump 53 is stopped, the fuel vapor flows into the atmosphere passage 13 through the adsorbent 34 in the second accommodating chamber 32 to be adsorbed.

As described above, in the first embodiment, since the concentration-detecting passage 51 communicates with the communicating passage 35 of the canister 20, the fuel vapor which has returned to the canister 20 from the concentration-detecting passage 51 recirculate through the adsorbent 33 into the purge passage 11, while the pump 53 is driven. Thereby, the concentration of the fuel vapor in the purge passage 11 is kept in an appropriate range. Even while the pump 53 is stopped, the fuel vapor is adsorbed by the adsorbent 34 in the second accommodating chamber 32 before it flows to the atmosphere passage 13 through the atmosphere port 22. Thus, the discharge of fuel vapor into the atmosphere is restricted.

Furthermore, in the first embodiment, since the concentration-detecting passage 51 connects the purge passage 11 with the canister 20 through the concentration-detecting unit 40, the air including the fuel vapor flowing in the purge passage 11 is introduced into the concentration-detecting unit 40 by the pump 53 without respect to the airflow in the purge passage 11. Thus, the accuracy of detecting the concentration of the fuel vapor is enhanced.

Second Embodiment

Figure 3:
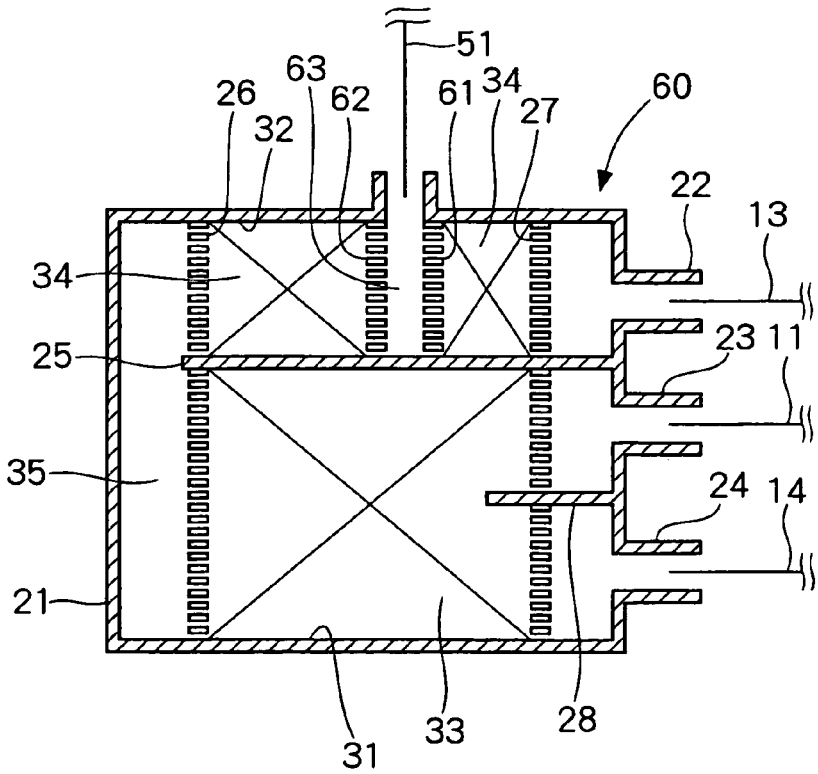
FIG. 3 is a cross sectional view showing a canister schematically according to a second embodiment.

FIG. 3 shows a fuel vapor treatment apparatus according to a second embodiment. The same parts and components as those in the first embodiment are indicated with the same reference numerals and the same description will not be reiterated.

The concentration-detecting passage 51 communicates with the second accommodating chamber 32. The canister 60 includes a first supporting plate 61 and a second supporting plate 62 in the second accommodating chamber 32. A communicating chamber 63 is defined between the first and second supporting plates 61, 62. The concentration-detecting passage 51 communicates with the communicating chamber 63, whereby the air including the fuel vapor that has returned to the canister 60 from the concentration-detecting passage 51 flows into the communicating chamber 63.

When the pump 53 is driven, the air including fuel vapor, which has returned to the canister 60 from the concentration-detecting passage 51, recirculate to the purge passage 11 through the second adsorbent 34 confronting the communicating passage 35 and the adsorbent 33 in the first accommodating chamber 31. When the pump is stopped, the fuel vapor is adsorbed by a portion of the adsorbent 34 confronting to the atmosphere port 22 before flowing out through the atmosphere port 22. The discharge of the fuel vapor into the atmosphere is restricted.

Third Embodiment

Figure 4:
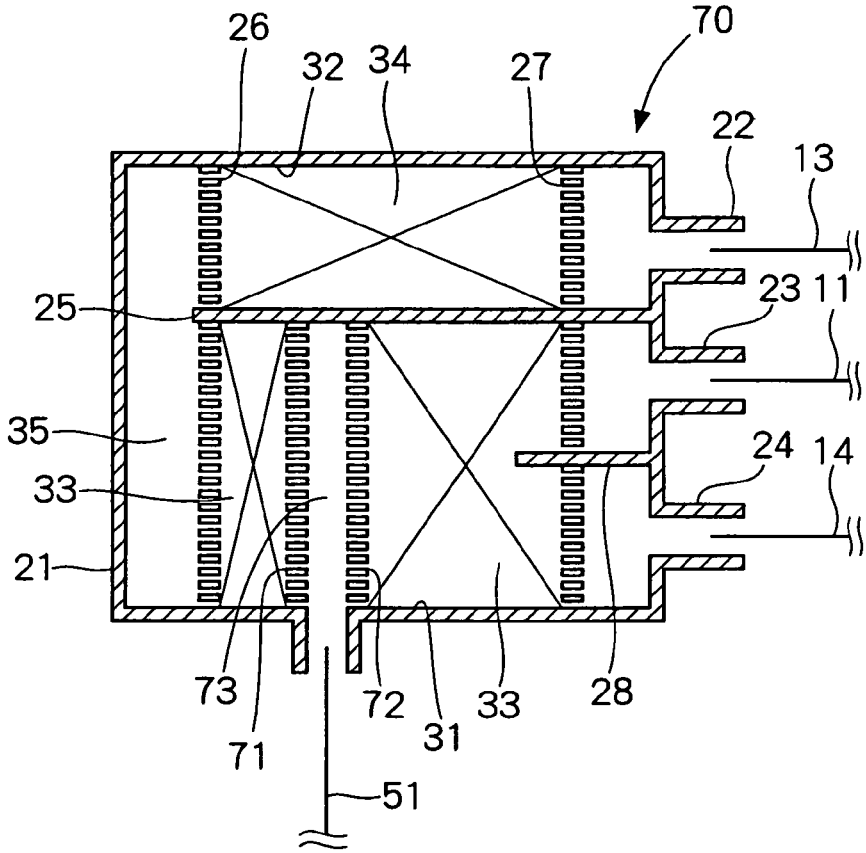
FIG. 4 is a cross sectional view showing a canister schematically according to a third embodiment.

FIG. 4 shows a fuel vapor treatment apparatus according to a third embodiment. The canister 70 includes a first supporting plate 71 and a second supporting plate 72 in the first accommodating chamber 31. A communicating chamber 73 is defined between the first supporting plate 71 and the second supporting plate 72. The communicating chamber 73 is arranged between the purge port 23, the tank port 24 and the communicating passage 35. The concentration-detecting passage 51 communicates with the communicating chamber 73.

Fourth Embodiment

Figure 5:
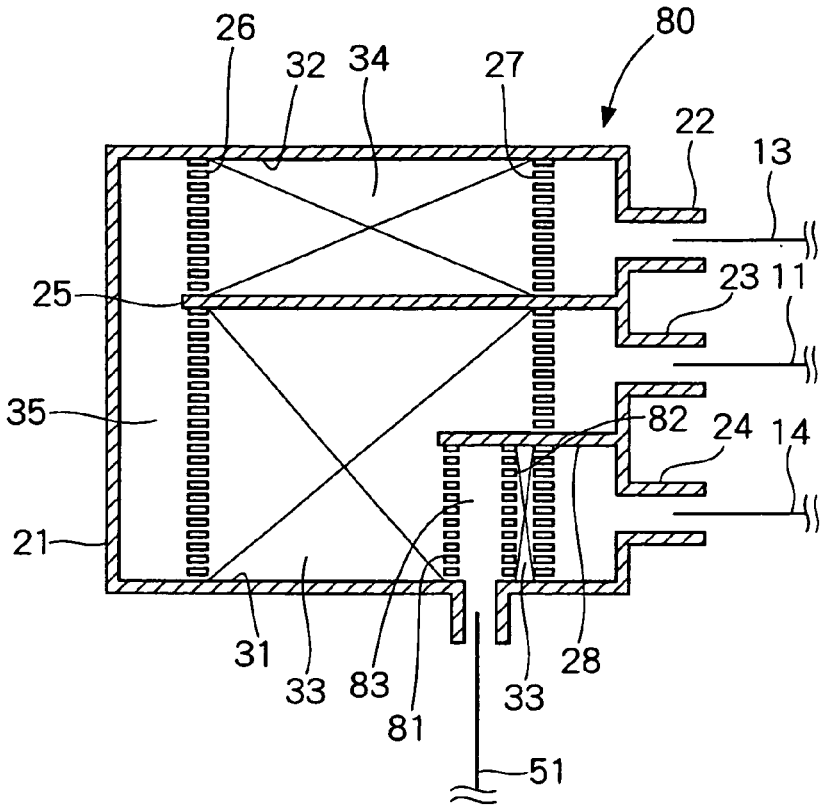
FIG. 5 is a cross sectional view showing a canister schematically according to a fourth embodiment.

FIG. 5 shows a fuel vapor treatment apparatus according to a fourth embodiment. The canister 80 includes a first supporting plate 81 and a second supporting plate 82 in the first accommodating chamber 31. A communicating chamber 83 is defined between the first supporting plate 81 and the second supporting plate 82. The first supporting plate 81 and the second supporting plate 82 are connected with the separator 28. The communicating chamber 83 is formed between the tank port 24 and the communicating passage 35. The concentration-detecting passage 51 communicates with the communicating chamber 83.

Fifth Embodiment

Figure 6:
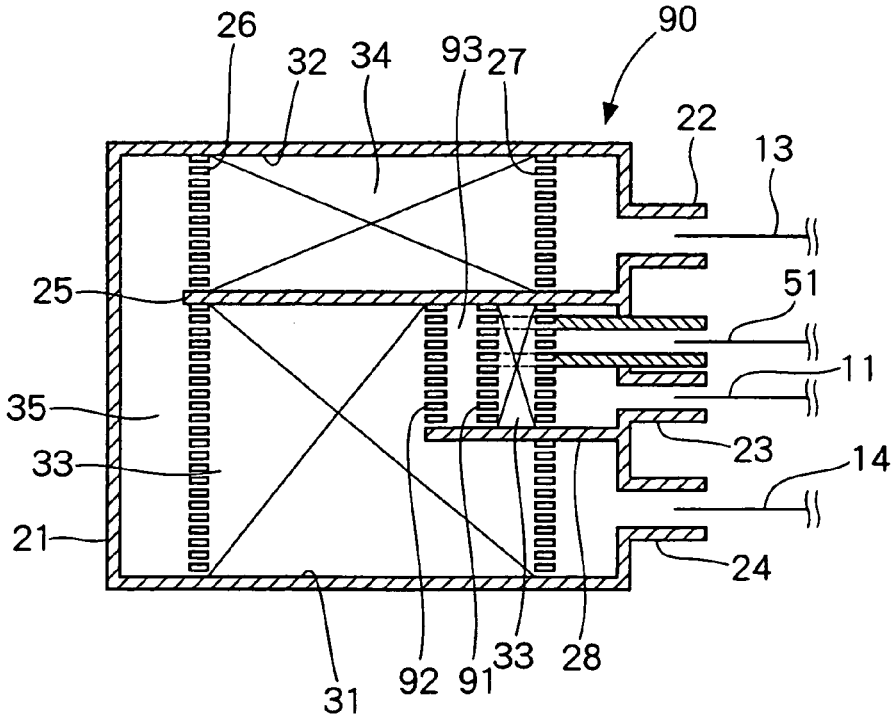
FIG. 6 is a cross sectional view showing a canister schematically according to a fifth embodiment.

FIG. 6 shows a fuel vapor treatment apparatus according to a fifth embodiment. The canister 90 includes a first supporting plate 91 and a second supporting plate 92 in the first accommodating chamber 31. A communicating chamber 93 is defined between the first supporting plate 91 and the second supporting plate 92. The first supporting plate 91 and the second supporting plate 92 are connected with the first separator 25 and the second separator 28, whereby the communicating chamber 93 is formed between the purge port 23 and the communicating passage 35. The concentration-detecting passage 51 communicates with the communicating chamber 93.

According to the third to fifth embodiments, since the concentration-detecting passage 51 communicates with the first accommodating chamber 31, the fuel vapor which has returned to the canister 20 from the concentration-detecting passage 51 recirculate through the adsorbent 33 into the purge passage 11, while the pump 53 is driven. Thereby, the concentration of the fuel vapor in the purge passage 11 is kept higher than that of the first and second embodiment. Even while the pump 53 is stopped, the fuel vapor is adsorbed by the adsorbents 33, 34 in the first and the second accommodating chamber 31, 32 before it flows to the atmosphere passage 13 through the atmosphere port 22. Thus, the discharge of fuel vapor into the atmosphere is restricted.

Sixth Embodiment

Figure 7:
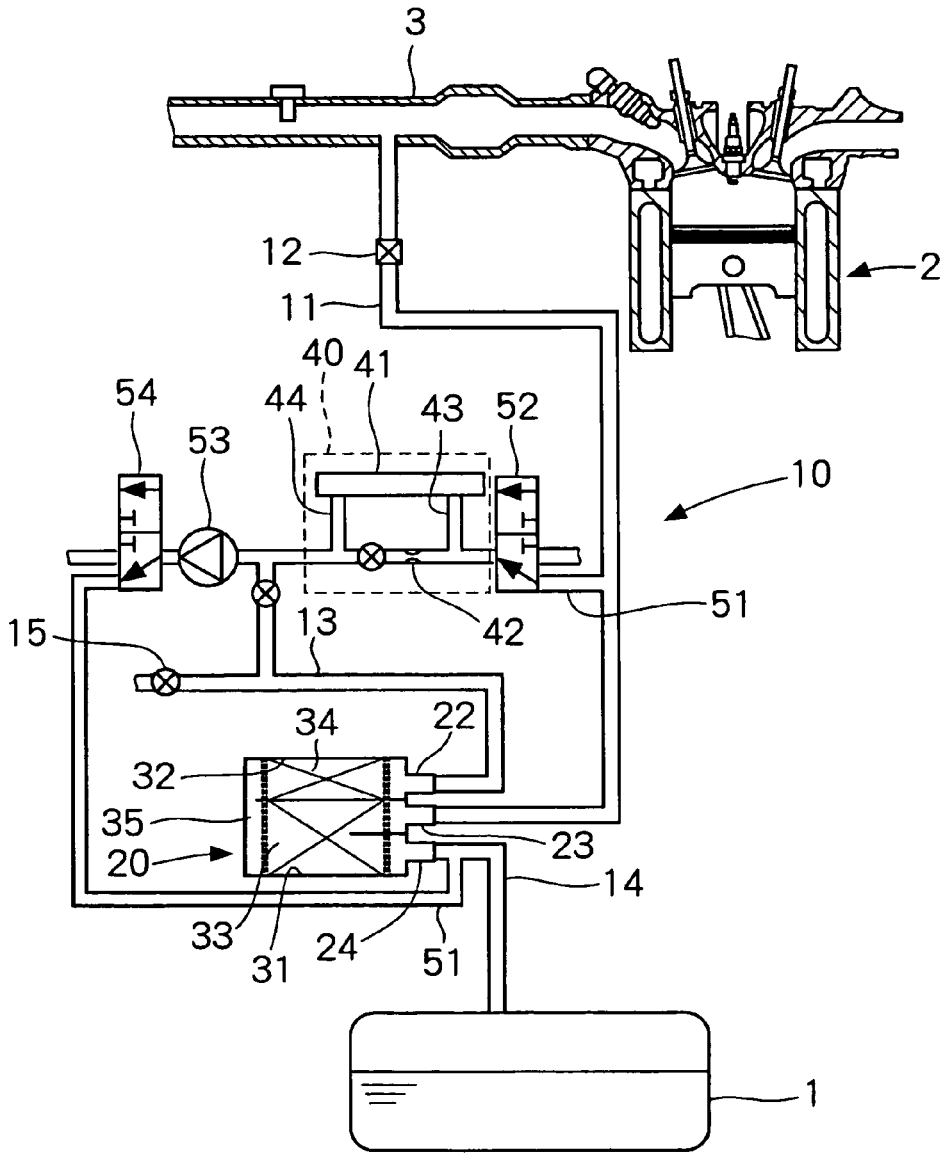
FIG. 7 is a schematic view of a fuel vapor treatment apparatus according to a sixth embodiment.

FIG. 7 shows a fuel vapor treatment apparatus according to a sixth embodiment. The concentration-detecting passage 51 communicates with the tank passage 14 that connects the fuel tank 1 with the tank port 24 of the canister 20. The air including the fuel vapor in the concentration-detecting passage 51 is returned to the canister 20 through the tank passage 14. This air is recirculated to the purge passage 11 through the adsorbent 33 in the first accommodating chamber 31, while the pump 53 is driven. The concentration of the fuel vapor in the purge passage 11 is lower than that of the fourth and fifth embodiments, and is greater than that of the first and second embodiments. Even while the pump 53 is stopped, the fuel vapor is adsorbed by the adsorbents 33, 34 in the first and the second accommodating chamber 31, 32 before it flows to the atmosphere passage 13 through the atmosphere port 22. Thus, the discharge of fuel vapor into the atmosphere is restricted.

Since the concentration-detecting passage 51 communicates with the tank passage 14, it is unnecessary to provide a connecting portion on the canister, which is connected to the concentration-detecting passage 51. Hence, the design change of the canister 20 is unnecessary to restrict the discharge of the fuel vapor into the atmosphere.

What is claimed is:

1. A fuel vapor treatment apparatus treating a fuel vapor evaporated in a fuel tank, the fuel vapor treatment apparatus comprising:

a canister accommodating an adsorbent adsorbing the fuel vapor, the canister including a tank port communicating with the fuel tank through a tank passage;

a purge passage connecting a purge port of the canister with an intake pipe of an internal combustion engine, the purge passage introducing an air including the fuel vapor described from the adsorbent into the intake pipe;

a concentration-detecting unit detecting a concentration of the fuel vapor contained in an air flowing in the purge passage;

an atmosphere passage communicating with an atmosphere port of the canister, through which an air flows into the canister and discharges from the canister; and a concentration-detecting passage connecting the purge passage with the canister through the concentration-detecting unit, wherein the concentration-detecting passage introduces the air including the fuel vapor into an intermediate portion of a space accommodating the adsorbent, the air including the fuel vapor is introduced to the concentration-detecting unit from the purge passage, and the atmosphere port and the purge port are connected to the space at both end portions thereof.

2. A fuel vapor treatment apparatus according to claim 1, further comprising a pump introducing the fuel vapor in the purge passage into the concentration-detecting unit.

3. A fuel vapor treatment apparatus according to claim 1, wherein the canister includes a first accommodating chamber, a second accommodating chamber, and a communicating passage, wherein the first accommodating chamber accommodate a first absorbent and communicates with the tank port and the purge port, the second accommodating chamber accommodates a second adsorbent and communicates with the atmosphere port, and the communicating passage connecting the first accommodating chamber with the second accommodating chamber at a side opposite to the purge port and the atmosphere port, and the concentration-detecting passage is connected to the communicating passage of the canister.

4. A fuel vapor treatment apparatus according to claim 1, wherein the canister includes a first accommodating chamber and a second accommodating chamber, the first accommodating chamber accommodating a first adsorbent and communicating with the tank port and the purge port, the second accommodating chamber accommodating a second adsorbent and communicating with the atmosphere port, the concentration-detecting passage is connected to the second accommodating chamber of the canister.

5. A fuel vapor treatment apparatus treating a fuel vapor evaporated in a fuel tank, the fuel vapor treatment apparatus comprising:

a canister accommodating an adsorbent adsorbing the fuel vapor, the canister including a tank port communicating with the fuel tank through a tank passage;

a purge passage connecting a purge port of the canister with an intake pipe of an internal combustion engine, the purge passage introducing an air including the fuel vapor described from the adsorbent into the intake pipe;

a concentration-detecting unit detecting a concentration of the fuel vapor contained in an air flowing in the purge passage;

an atmosphere passage communicating with an atmosphere port of the canister, through which an air flows into the canister and discharges from the canister; and a concentration-detecting passage connecting the purge passage with the canister or the tank passage through the concentration-detecting unit, the concentration-detecting passage introducing the air including the fuel vapor, which is introduced into the concentration-detecting unit from the purge passage, into a space between the atmosphere port and the fuel tank.

6. A fuel vapor treatment apparatus according to claim 5, wherein the canister includes a first accommodating chamber accommodating a first adsorbent and communicating with the tank port and the purge port, the canister includes a second accommodating chamber accommodating a second adsorbent and communicating with the atmosphere port, and the concentration-detecting passage communicates with the first accommodating chamber of the canister.

7. A fuel vapor treatment apparatus according to claim 5, wherein the canister includes a first accommodating chamber accommodating a first adsorbent and communicating with the thank port and the purge port, the canister includes a second accommodating chamber accommodating a second adsorbent and communicating with the atmosphere port, and the concentration-detecting passage communicates with the tank passage between the fuel tank and the canister.

8. A fuel vapor treatment apparatus treating a fuel vapor evaporated in a fuel tank, the fuel vapor treatment apparatus comprising:

a canister including a space in which an adsorbent adsorbing the fuel vapor is accommodated, the canister including a tank port communicating with the fuel tank through a tank passage;

a purge passage connecting a purge port of the canister with an intake pipe of an internal combustion engine, the purge passage introducing an air including the fuel vapor described from the adsorbent into the intake pipe;

a concentration-detecting unit detecting a concentration of the fuel vapor contained in an air flowing in the purge passage;

an atmosphere passage communicating with an atmosphere port of the canister, through which an air flows into the canister and discharges from the canister; and a concentration-detecting passage connecting the purge passage with the canister through the concentration-detecting unit, wherein the concentration-detecting passage introduces the fuel vapor into the space between the atmosphere port and the purge port, the fuel vapor is introduced to the concentration-detecting unit from the purge passage.

* * * * *